US006273356B1

(12) United States Patent
Burton

(10) Patent No.: US 6,273,356 B1
(45) Date of Patent: Aug. 14, 2001

(54) ROLL REWINDING APPARATUS

(75) Inventor: Michael Burton, Bridlington (GB)

(73) Assignee: Holmdale Precision Ltd., East Yorkshire (GB)

( * ) Notice: Subject to any disclaimer, the term of this patent is extended or adjusted under 35 U.S.C. 154(b) by 0 days.

(21) Appl. No.: 09/553,433

(22) Filed: Apr. 19, 2000

(30) Foreign Application Priority Data

Apr. 23, 1999 (GB) ..... 9909228

(51) Int. Cl.[7] ..... B65H 35/04
(52) U.S. Cl. ..... 242/527.3; 242/533.4
(58) Field of Search ..... 242/527, 527.3, 242/533.4, 533.5, 559.2

(56) References Cited

U.S. PATENT DOCUMENTS

| | | | | |
|---|---|---|---|---|
| 2,586,833 | * | 2/1952 | Kohler et al. | 242/527.3 |
| 4,153,215 | * | 5/1979 | Schulze | 242/527.3 |
| 4,630,783 | * | 12/1986 | Miifarth | 242/533.4 |
| 5,660,349 | * | 8/1997 | Miller et al. | 242/527 |

FOREIGN PATENT DOCUMENTS

| | | | | |
|---|---|---|---|---|
| 403216445 | * | 9/1991 | (JP) | 242/533.4 |

* cited by examiner

*Primary Examiner*—Emmanuel M. Marcelo
(74) *Attorney, Agent, or Firm*—Fay, Sharpe, Fagan, Minnich & McKee, LLP

(57) ABSTRACT

An apparatus for continuously winding a web of sheet material into rolls comprises a turret mechanism (1) comprising two or more winding mandrels (2,3,4,5).

Figure 1:
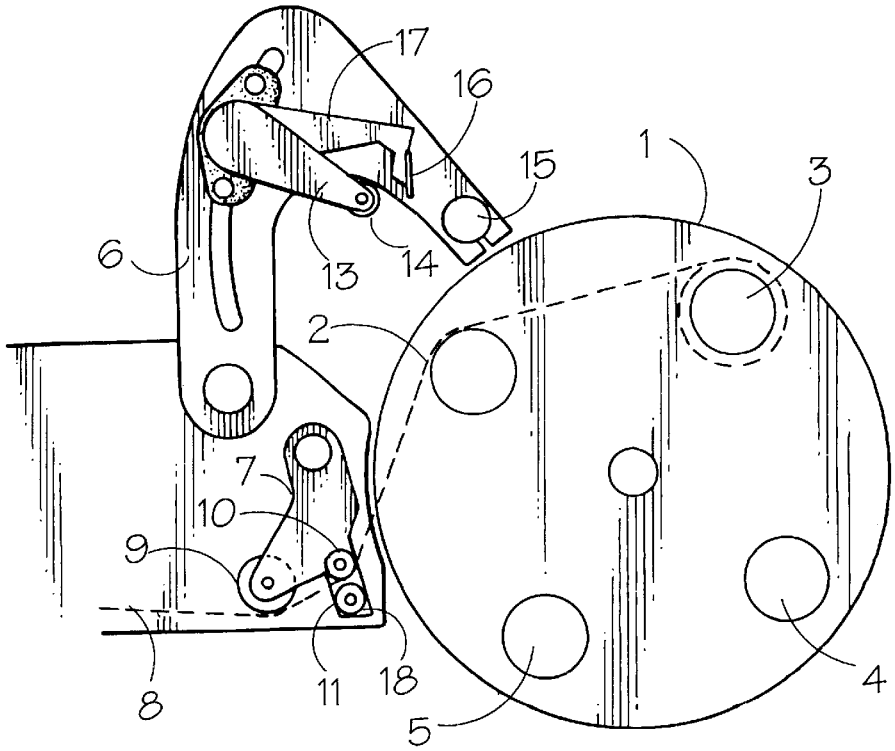

The turret mechanism (1) is rotatably indexed to bring each mandrel (2,3,4,5) in turn into a winding position in which it is rotatably driven to wind a web of sheet material (8) connected thereto into a roll, and to bring the adjacent mandrel lying immediately behind it in the direction of rotation of the turret into contact with the web (8). The adjacent mandrel is rotatable.

Rotary element (11) is adapted for selective engagement with the adjacent mandrel, which rotary element (11) is rotatably driven in the opposite direction to the adjacent mandrel and at a greater speed.

The apparatus further comprises a web cutting mechanism (16) adapted to cut the web (8) at a point lying between the current rewind mandrel and the adjacent mandrel. The cut end of the web is directed by the cutting mechanism between the adjacent mandrel and the rotary element (11), such that by rotating the adjacent mandrel through a few turns the web is wrapped around it. The turret is then indexed forward to move the adjacent mandrel into the rewind position.

20 Claims, 1 Drawing Sheet

ROLL REWINDING APPARATUS

The present invention relates to apparatus for continuously winding a web of sheet material into rolls. The apparatus of the present invention may be employed to rewind a web of sheet material from a primary roll on a first mandrel (the unwind mandrel) into a smaller, secondary roll on a second mandrel (the rewind mandrel). Alternatively, it may be employed at the output end of web manufacturing apparatus to wind the web into rolls as it leaves the manufacturing apparatus.

It is known within the label manufacturing industry to rewind rolls of labels from a primary roll. The labels may be formed as a continuous web or may, particularly in the case of adhesive labels, be carried on a continuous web of backing material. The secondary rolls are wound from the primary roll to form smaller secondary rolls of a manageable size and having a diameter which allows them to be received within label dispensing apparatus. Ticket rolls and till rolls are also formed in this way; that is to say smaller, secondary rolls are wound from a primary roll. The secondary rolls may be wound from the primary roll onto cores or may be coreless.

Each time a secondary roll is rewound from the primary roll the web of material connecting the two rolls must be cut and the free end of the primary roll must be picked up and connected to the rewind mandrel of the winding machine or, in the case of cored rolls, against a core positioned on the rewind mandrel so that rewinding of the next secondary roll can begin.

Where the web of material is rewound onto a core it is known to attach the free end of the primary roll to the core using adhesive or double-sided sticky tape pre-applied to the core itself. The disadvantage of this approach is that the adhesive or double-sided sticky tape can adhere to the back of the web itself, thus causing the last few centimetres of the roll to be wasted. Where the roll carries sequentially numbered labels or tickets this is not acceptable for obvious reasons. Moreover, the adhesive may attach itself to parts of the end use apparatus in which the roll is employed, causing the end use apparatus to be disabled or even damaged.

Where the web of material is rewound directly onto the rewind mandrel it is known to insert the free end of the primary roll into a mechanical clamp carried by the rewind mandrel. The disadvantage of this approach is that the web must be stationary during insertion of the free end in the clamp and therefore it cannot be employed as part of a continuous web feed process, for example, on the end of a printing press, unless an accumulator is positioned between the press and the turret rewinder.

It is an object of the present invention to provide an apparatus for continuously winding a web of sheet material into rolls which obviates or at least substantially mitigates the problems associated with the prior art which have been identified hereinabove.

According to a first aspect of the present invention there is provided an apparatus for continuously winding a web of sheet material into rolls, the apparatus comprising:

i) a turret mechanism comprising two or more winding mandrels;

ii) means for rotatably indexing the turret mechanism to bring each mandrel in turn into a winding position in which it is rotatably driven to wind a web of sheet material connected thereto into a roll, and to bring the adjacent mandrel lying immediately behind it in the direction of rotation of the turret into contact with the web;

iii) drive means for selectively rotatably driving the said adjacent mandrel;

iv) rotary means adapted for selective engagement with the said adjacent mandrel, which rotary means is rotatably driven in the opposite direction to the said adjacent mandrel and at a greater speed;

v) web cutting means adapted to cut the web at a point lying between the current rewind mandrel and the said adjacent mandrel;

vi) means adapted to direct the cut end of the web between the said adjacent mandrel and the said rotary means; and vii) control means for rotatably driving the said adjacent mandrel through a plurality of turns to wrap the web around it and for operating the indexing means to move the said adjacent mandrel into the rewind position.

When a roll has been wound onto the current winding mandrel to a predetermined diameter the rotary means is brought into engagement with the mandrel immediately adjacent to and behind it. Simultaneously, the said adjacent mandrel is rotatably driven, but at a speed slower than the rotary means and in the opposite direction thereto. The cutting means is then operated to cut the web and sever the connection with the roll on the current winding mandrel. The cut end of the web is then directed between the rotary means and the said adjacent mandrel. Owing to the greater rotational speed of the rotary means the web is pulled tight around the more slowly rotating mandrel. The rotary means continues to pull the web tightly against the mandrel for a predetermined number of revolutions of the mandrel at which point is can be disengaged from the mandrel. The web is now wrapped tightly around the mandrel and secured to it. The indexing means is now operated to move the current winding mandrel forward so that the finished roll carried by it can be removed and to bring the said adjacent mandrel into the winding position just vacated where winding of the next roll can resume.

It will be seen that the apparatus of the present invention allows rolls of web to be wound. The rolls may be wound directly on the mandrels carried by the turret or may be wound onto cores positioned over the mandrels. In either case operation of the apparatus is much the same. Where the rolls are wound on cores the apparatus may be used in conjunction with an automatic core loading device.

The apparatus of the present invention may be used to form smaller, secondary rolls from a larger primary roll of material, or may be situated at the output end of a web manufacturing apparatus. The apparatus may be used in line with web converting apparatus which print directly on the web, carry our pressing operations and the like as the web passes through to the apparatus of the present invention.

In a preferred embodiment of the present invention the rotary means comprises a roller mounted on an arm which is moveable to engage and disengage the roller with the said adjacent mandrel. Preferably, an idler roller is mounted on the arm adjacent to the roller and the web passes between the idler roller and the said adjacent mandrel before passing over the said adjacent mandrel towards the current winding mandrel. The idler roller serves to guide the cut end of the web under the web at the point where it first joins the said adjacent mandrel.

When the arm is moved to the engaged position, in which position the said adjacent mandrel is rotatably driven, the idler roller also engaged with the said adjacent mandrel and is rotatably driven thereby. Conveniently, the said driven roller takes its drive the said idler roller and to this end it is connected to the idler roller through a geared arrangement.

Preferably, the apparatus further comprises a guide roller located between the said adjacent mandrel and the current winding mandrel which causes the web to be guided around the said adjacent mandrel and into close proximity with the said rotary means. The guide roller may be mounted on an arm which is moveable between a first disengaged position and a second position in which it engages with the web.

Conveniently, the cutting means also serves to direct the cut end of the web between the said rotary means and the said adjacent mandrel.

Preferably, the arm carrying the rotary means comprises an anvil over which the portion of web extending between the said adjacent mandrel and the current rewinding mandrel passes and against which the cutting means operates to cut the web.

The apparatus may further comprise an additional idler roller adapted to hold the web against the said adjacent mandrel prior to the operation of the cutting means to ensure that the cut end of the web is retained in contact with the said adjacent mandrel.

Preferably, each of the mandrels is connected to rotary drive means through a clutch mechanism which is selectively operable to connect and disconnect each mandrel thereto.

According to a second aspect of the present invention there is provided a method of continuously winding a web of sheet material into rolls, the method comprising:

i) connecting the free end of the web to a first of two or more winding mandrels mounted on turret mechanism;

ii) rotatably indexing the turret mechanism to bring each mandrel in turn into a winding position in which it is rotatably driven to wind the web of sheet material into a roll and to bring the adjacent mandrel lying immediately behind it in the direction of rotation of the turret mechanism into engagement with the web of sheet material;

iii) rotatably driving the current winding mandrel to form thereon a roll of a predetermined diameter;

iv) rotatably driving the said adjacent mandrel;

v) engaging rotary means with the said adjacent mandrel which rotary means rotates in the opposite direction to the said adjacent mandrel and at a greater speed;

vi) cutting the web at a point between the said adjacent mandrel and the current winding mandrel;

vii) directing the free end of the web between the said rotary means and the said adjacent mandrel such that the web is pulled tightly around the mandrel as a result of the greater rotation speed of the rotary means;

viii) rotating the said adjacent mandrel through a predetermined number of revolutions to securely wrap the free end of the web; and viii) operating the indexing means to index the turret mechanism forward such that the said adjacent mandrel assumes the position of the current winding mandrel and the mandrel immediately behind it engages with the web.

Figure 2:
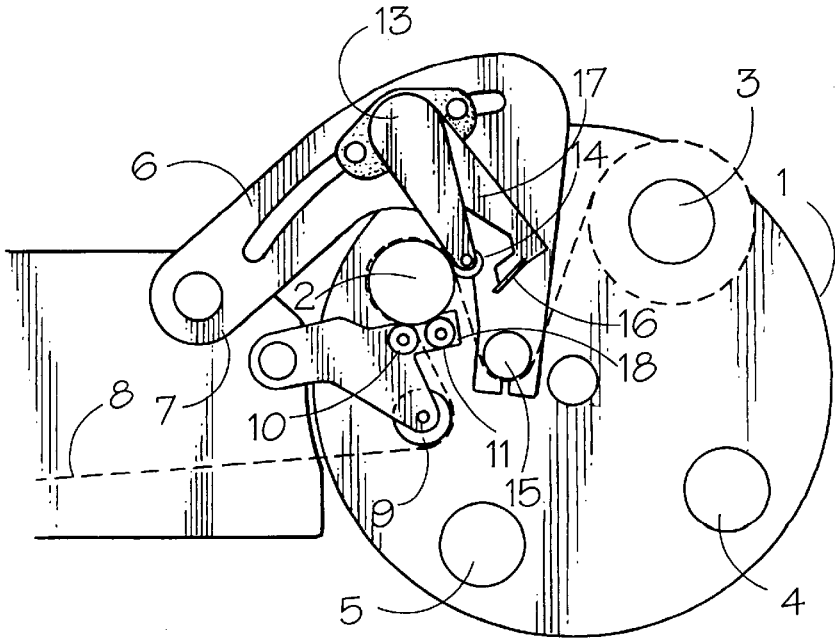

Embodiments of the present invention will now be described by way of example with reference to the accompanying drawings, in which;

FIG. 1 shows a front view of a roll winding apparatus embodying the present invention in its start position; and, FIG. 2 shows the roll winding apparatus of FIG. 1 immediately prior to cutting the web to leave a finished roll on a first one of the rewinding mandrels and to commence rewinding of the next roll on the rewinding mandrel immediately following the first.

Referring to FIGS. 1 and 2, the apparatus consists of an indexable turret mechanism 1, which supports four rewinding mandrels 2, 3, 4 and 5. Lying immediately adjacent to the turret mechanism is a top arm 6 and a bottom arm 7. It can be seen that the web of material 8 is fed in to the rewinding apparatus from the left hand side thereof as viewed in the drawings.

FIG. 1 shows the apparatus in its start position, which is also the position that the top and bottom arms 6 and 7 return to after each indexing movement of turret mechanism 1. The web of material 8 is connected to the rewinding mandrel 3 after being routed around the outside edge of rewinding mandrel 2 lying immediately behind rewinding mandrel 3 in the direction of indexing of the indexing mechanism 1. The web 8 is also routed over idler roller 9 and between rubber coated idler roller 10 and rubber coated driven roller 11. The rollers 9, 10 and 11 are all carried on the bottom arm 7.

When the apparatus is started, rewinding mandrel 3 rotates to take up any slackness in the web 8 and the top arm 6 and the bottom arm 7 advance to the positions shown in FIG. 2. It will be seen that the web is guided around the rewinding mandrel 2 by a guide roller 15 at the end of the top arm 6. This guide roller 15 brings the web into close proximity with the driven roller 11 and with the web 8 as it joins onto the rewinding mandrel 2. At this point the apparatus begins rewinding the web onto the rewind mandrel 3.

Rewinding continues like this until the roll formed on rewinding mandrel 3 reaches a predetermined size. At this point arm 13 which is supported on the top arm 6 pivots clockwise to bring an idler roller 14 carried at the free end thereof against the web and the rewinding mandrel 2.

At this point it will be helpful to point out that the driven roller 11 is rotating in the opposite direction to the rewinding mandrel 2 and at a greater speed. Consequently, it is rotating faster than the line speed of the web 8. The idler roller 10 is held against the rewind mandrel and is, therefore running at the same speed.

When the roll of web material on the rewinding mandrel 3 has reached a predetermined finished size a knife 16 supported on a pivotable arm 17 is rotated clockwise towards that part of the web 8 held between the guide roller 15 and the idler roller 14. The knife 16 cuts through the web against an anvil 18 carried by the bottom arm 7. At the same time the knife 16 causes the cut end of the web 8 to be pushed between the rewinding mandrel 2 and the driven roller 11.

The greater speed of the driven roller 11 causes the cut end of the web 8 to be pulled tightly around the rewinding mandrel 2. This action ensures that the web grips the mandrel (or a core positioned thereon) and allows further rewinding. After a predetermined number of "wraps" the knife retracts, followed by the arm 13 and the driven roller 11. Then, both the top arm 6 and the bottom arm 7 retract to the allow the turret mechanism to index to its next position as shown in FIG. 1. The rewinding mandrel 2 has now assumed the position of the current rewinding mandrel and is rotatably driven to form a roll thereon of the required diameter. The rewinding mandrel 5 assumes the position previously occupied by rewind mandrel 2 with the web passing around the outside edge thereof. It will be understood that when the roll wound onto rewinding mandrel 2 reaches the required diameter the apparatus operates as described hereinabove to cut the web and secure the cut end to the rewinding mandrel 5.

Finished roll ejection and the loading of new cores is carried out during the rewinding process.

The slot in the top arm 6 allows the apparatus to accommodate different core sizes.

What is claimed is:

1. Apparatus for continuously winding a web of sheet material into rolls, the apparatus comprising:

i) a turret mechanism (1) comprising two or more winding mandrels (2,3,4,5);

ii) means for rotatably indexing the turret mechanism (1), to bring each mandrel (2,3,4,5) in turn into a winding position in which it is rotatably driven to wind a web of sheet material (8) connected thereto into a roll, and to bring the adjacent mandrel lying immediately behind it in the direction of rotation of the turret into contact with the web (8);

iii) drive means for selectively rotatably driving the said adjacent mandrel;

iv) rotary means (11) adapted for selective engagement with the said adjacent mandrel, which rotary means (11) is rotatably driven in the opposite direction to the said adjacent mandrel and at a greater speed;

v) web cutting means (16) adapted to cut the web (8) at a point lying between the current rewind mandrel and the said adjacent mandrel;

vi) means (16) adapted to direct the cut end of the web between the said adjacent mandrel and the said rotary means (11); and vii) control means for rotatably driving the said adjacent mandrel through a plurality of turns to wrap the web around it and for operating the indexing means to move the said adjacent mandrel into the rewind position.

2. Apparatus according to claim 1, wherein the rotary means (11) comprises a driven roller mounted on an arm (7) which is moveable to engage and disengage the driven roller with the said adjacent mandrel.

3. Apparatus according to claim 2, wherein an idler roller (10) is mounted on the arm (7) adjacent to the driven roller which idler roller (10) engages with the said adjacent mandrel when the arm (7) is moved to engage the driven roller therewith, and the web passes between the idler roller (10) and the said driven roller before passing over the said adjacent mandrel towards the current winding mandrel.

4. Apparatus according to claim 3, wherein the idler roller (10) is rotatably driven by the said adjacent mandrel when engaged therewith.

5. Apparatus according to claim 4, wherein the driven roller takes its drive from the said idler roller.

6. Apparatus according to claim 5, further comprising a guide roller (15) located between the said adjacent mandrel and the current winding mandrel which causes the web (8) to be guided around the said adjacent mandrel and into close proximity with the said rotary means (11).

7. Apparatus according to claim 5, wherein the cutting means (16) also serves to direct the cut end of the web between the said rotary means (11) and the said adjacent mandrel.

8. Apparatus according to claim 4, further comprising a guide roller (15) located between the said adjacent mandrel and the current winding mandrel which causes the web (8) to be guided around the said adjacent mandrel and into close proximity with the said rotary means (11).

9. Apparatus according to claim 4, wherein the cutting means (16) also serves to direct the cut end of the web between the said rotary means (11) and the said adjacent mandrel.

10. Apparatus according to claim 3, further comprising a guide roller (15) located between the said adjacent mandrel and the current winding mandrel which causes the web (8) to be guided around the said adjacent mandrel and into close proximity with the said rotary means (11).

11. Apparatus according to claim 3, wherein the cutting means (16) also serves to direct the cut end of the web between the said rotary means (11) and the said adjacent mandrel.

12. Apparatus according to claim 2, further comprising a guide roller (15) located between the said adjacent mandrel and the current winding mandrel which causes the web (8) to be guided around the said adjacent mandrel and into close proximity with the said rotary means (11).

13. Apparatus according to claim 2, wherein the cutting means (16) also serves to direct the cut end of the web between the said rotary means (11) and the said adjacent mandrel.

14. Apparatus according to claim 1, further comprising a guide roller (15) located between the said adjacent mandrel and the current winding mandrel which causes the web (8) to be guided around the said adjacent mandrel and into close proximity with the said rotary means (11).

15. Apparatus according to claim 14, wherein the guide roller is mounted on an arm (6) which is moveable between a first disengaged position and a second position in which it engages with the web (8).

16. Apparatus according to claim 1, wherein the cutting means (16) also serves to direct the cut end of the web between the said rotary means (11) and the said adjacent mandrel.

17. Apparatus according to claim 1, wherein the arm (7) carrying the rotary means (11) comprises an anvil (18) over which the portion of web (8) extending between the said adjacent mandrel and the current rewinding mandrel passes and against which the cutting means (16) operates to cut the web.

18. Apparatus according to claim 1, further comprising an additional idler roller (14) adapted to hold the web (8) against the said adjacent mandrel prior to the operation of the cutting means (16) to ensure that the cut end of the web (8) is retained in contact with the said adjacent mandrel.

19. Apparatus according to any preceding claim 1, wherein each of the mandrels is connected to rotary drive means through a clutch mechanism which is selectively operable to connect and disconnect each mandrel thereto.

20. A method of continuously winding a web of sheet material into rolls, the method comprising:

i) connecting the free end of the web to a first of two or more winding mandrels mounted on turret mechanism;

ii) rotatably indexing the turret mechanism to bring each mandrel in turn into a winding position in which it is rotatably driven to wind the web of sheet material into a roll and to bring the adjacent mandrel lying immediately behind it in the direction of rotation of the turret mechanism into engagement with the web of sheet material;

iii) rotatably driving the current winding mandrel to form thereon a roll of a predetermined diameter;

iv) rotatably driving the said adjacent mandrel;

v) engaging rotary means with the said adjacent mandrel which rotary means rotates in the opposite direction to the said adjacent mandrel and at a greater speed;

vi) cutting the web at a point between tie said adjacent mandrel and the current winding mandrel;

vii) directing the free end of the web between the said rotary means and the said adjacent mandrel such that the web is pulled tightly around the mandrel as a result of the greater rotation speed of the rotary means;

viii) rotating the said adjacent mandrel through a predetermined number of revolutions to securely wrap the free end of the web; and ix) operating the indexing means to index the turret mechanism forward such that the said adjacent mandrel assumes the position of the current winding mandrel and the mandrel immediately behind it engages with the web.

* * * * *